US011457751B2

(12) United States Patent
Nguyen et al.

(10) Patent No.: US 11,457,751 B2
(45) Date of Patent: Oct. 4, 2022

(54) FLOORSTAND WITH SHELF SUPPORT

(71) Applicant: WestRock Shared Services, LLC, Atlanta, GA (US)

(72) Inventors: Eric T. Nguyen, Diamond Bar, CA (US); Alexander C. Sin, Winston-Salem, NC (US); Jerry R. Frost, Lewisville, NC (US)

(73) Assignee: WESTROCK SHARED SERVICES, LLC, Atlanta, GA (US)

( * ) Notice: Subject to any disclaimer, the term of this patent is extended or adjusted under 35 U.S.C. 154(b) by 0 days.

(21) Appl. No.: 16/821,517

(22) Filed: Mar. 17, 2020

(65) Prior Publication Data

US 2020/0297132 A1 Sep. 24, 2020

Related U.S. Application Data

(60) Provisional application No. 62/820,632, filed on Mar. 19, 2019.

(51) Int. Cl.
*A47F 5/11* (2006.01)

(52) U.S. Cl.
CPC ..... *A47F 5/116* (2013.01)

(58) Field of Classification Search
CPC ..... A47F 3/004; A47F 5/116; A47F 5/112; A47F 5/10; A47F 5/0018; A47F 5/11; A47B 43/00; A47B 43/02; A47B 47/06
USPC ..... 211/135
See application file for complete search history.

(56) References Cited

U.S. PATENT DOCUMENTS

| | | | | |
|---|---|---|---|---|
| 5,213,220 | A * | 5/1993 | McBride | A47B 43/00 211/126.16 |
| 6,715,623 | B2 * | 4/2004 | Broerman | A47F 5/116 211/149 |
| 7,677,433 | B2 * | 3/2010 | Little | B65D 5/526 229/120.15 |
| 8,485,370 | B2 | 7/2013 | Dewhurst | |
| 8,857,633 | B2 | 10/2014 | Dewhurst | |
| 10,448,758 | B1 * | 10/2019 | Abel | A47F 5/116 |
| 10,463,176 | B1 * | 11/2019 | Sells | A47F 5/108 |
| 10,470,591 | B1 * | 11/2019 | Heiden | B31D 5/04 |
| 10,524,588 | B2 * | 1/2020 | Pratsch | A47B 43/02 |
| 10,568,439 | B2 * | 2/2020 | Bersamin | A47F 3/004 |
| 10,888,180 | B2 * | 1/2021 | Robinson | A47F 5/16 |
| 10,905,260 | B2 * | 2/2021 | Hara | A47F 5/114 |
| 11,019,943 | B2 * | 6/2021 | Burgert | A47F 5/116 |

(Continued)

*Primary Examiner* — Devin K Barnett
(74) *Attorney, Agent, or Firm* — Neil G. Cohen

(57) ABSTRACT

A container includes a plurality of panels connected together at fold lines configured for extending at least partially around an interior space, where the plurality of panels includes a shelf panel defining at least one shelf flap, a first side panel, a back panel, and a second side panel. The container includes a support panel defining at least one shelf support flap. The shelf support flap is operatively connected the shelf flap of the shelf panel, and is configured to move between a first position and a second position when the shelf flap of the shelf panel is folded. A blank for a container includes a plurality of panels connected together at fold lines configured to be folded at least partially around an interior space, including a back panel. The blank includes a support panel. The support panel is connected to the back panel along a break line.

4 Claims, 7 Drawing Sheets

(56) References Cited

U.S. PATENT DOCUMENTS

| | | | | |
|---|---|---|---|---|
| 2006/0151407 | A1* | 7/2006 | Virvo | A47F 5/116 211/72 |
| 2008/0169339 | A1* | 7/2008 | Moser | B65D 5/5213 229/108.1 |
| 2008/0169340 | A1* | 7/2008 | Sheffer | A47F 5/116 229/120.32 |
| 2008/0265726 | A1* | 10/2008 | Sheffer | A47B 47/06 312/259 |
| 2010/0006529 | A1* | 1/2010 | Groff | A47F 5/116 211/186 |
| 2011/0049072 | A1* | 3/2011 | Dewhurst | A47F 5/116 211/135 |
| 2015/0068998 | A1* | 3/2015 | Smith | A47F 5/116 211/135 |
| 2017/0079449 | A1* | 3/2017 | Smith | A47B 43/02 |
| 2017/0295927 | A1* | 10/2017 | Gibbons, Jr. | A47B 43/02 |
| 2018/0042405 | A1* | 2/2018 | Lilja | A47F 5/116 |
| 2019/0061990 | A1* | 2/2019 | Sin | B65D 5/22 |
| 2019/0350383 | A1* | 11/2019 | Bersamin | A47F 5/116 |
| 2019/0380513 | A1* | 12/2019 | Frost | A47F 5/116 |

* cited by examiner

FLOORSTAND WITH SHELF SUPPORT

REFERENCE TO RELATED APPLICATION

This application claims the benefit of priority under 35 U.S.C. § 119(e) of U.S. Provisional application Ser. No. 62/820,632 filed on Mar. 19, 2019, which is hereby incorporated by reference in its entirety.

BACKGROUND OF THE INVENTION

Field of the Invention

The present disclosure relates to displays, and more particularly to retail merchandising displays.

Description of Related Art

In the retail environment, various containers are provided for shipping or for display of a product, such as pop-up displays, floor stand displays. The pre-assemblies for conventional pop-up displays usually require costly hand finishing and special machine gluing to be made prior to shipping to their retail location. Moreover, in-store set-up time for conventional pop-up displays can be time consuming. The displays can include shelves for holding and displaying goods.

The conventional techniques have been considered satisfactory for their intended purpose. However, there is an ever present need for improved pop-up displays. This disclosure provides a solution for this need.

SUMMARY OF THE INVENTION

A container includes a plurality of panels connected together at fold lines configured for extending at least partially around an interior space, where the plurality of panels includes a shelf panel defining at least one shelf flap, a first side panel, a back panel, and a second side panel. The container includes a support panel defining at least one shelf support flap. The at least one shelf support flap is operatively connected to the at least one shelf flap of the shelf panel. The support panel is configured to move between a first position and a second position when the at least one shelf flap of the shelf panel is folded.

In an embodiment, the first side panel is connected to the shelf panel along a respective one of the fold lines. The second side panel can be connected to the shelf panel along a respective one of the fold lines opposite from the first side panel. The support panel can be configured to move between the first position and the second position when the at least one shelf flap of the shelf panel is folded about a respective fold line between the at least one shelf flap and an upright portion of the shelf panel. The container can include side support panels connected to the support panel at respective fold lines. The container can include support flanges connected to the side support panels at respective fold lines. The support flanges and side support panels can be configured to slide between a first position and a second position when the at least one shelf flap of the shelf panel is folded about a respective fold line between the at least one shelf flap and an upright portion of the shelf panel. The support flanges can be configured to be folded at an oblique angle relative to their respective side support panels and abut an underside surface of the at least one shelf support flap. The back panel can include two back panel portions. The two back panel portions can be adhered together.

In accordance with another aspect, a blank for a container includes a plurality of panels connected together at fold lines configured to be folded at least partially around an interior space, including a shelf panel defining at least one shelf flap, a first side panel, a back panel, and a second side panel. The blank includes a support panel defining at least one shelf support flap. The support panel is connected to the back panel along a break line.

The break line can be weakened to facilitate breaking the back panel from the support panel by at least one of a knife cut and/or perforations. The support panel can be configured to move between a first position and a second position when the at least one shelf flap of the shelf panel is folded about a respective fold line between the at least one shelf flap and an upright portion of the shelf panel. The blank can include side support panels connected to the support panel at respective fold lines. The blank can include support flanges connected to the side support panels at respective fold lines. The support flanges and side support panels can be configured to slide between a first position and a second position when the at least one shelf flap of the shelf panel is folded about a respective fold line between the at least one shelf flap and an upright portion of the shelf panel. The support flanges can be configured to be folded at an oblique angle relative to their respective side support panels and abut an underside surface of the at least one shelf support flap. The first side panel can be connected to the shelf panel along a respective one of the fold lines. The second side panel can be connected to the shelf panel along a respective one of the fold lines opposite from the first side panel. The back panel can include a first back panel portion and a second back panel portion. The first back panel portion can be connected to the first side panel along a fold line. The second back panel portion can be connected to the second side panel along a fold line.

A method of forming a container includes folding a plurality of panels of a blank connected together at fold lines. The panels include a shelf panel defining at least one shelf flap, a first side panel, a back panel, a second side panel, and a support panel. The support panel defines at least one shelf support flap. The method includes adhering the at least one shelf support flap to the at least one shelf flap. The method includes separating the support panel from the back panel along a break line.

Folding the plurality of panels can include folding the support panel about a fold line between the back panel and the support panel and folding the first side panel along a fold line between the first side panel and the shelf panel. The method can include folding the at least one shelf flap along a fold line between the at least one shelf flap and an upright portion of the shelf panel and sliding the support panel downward relative to the back panel from a first position to a second position. The method can include folding side support panels along respective fold lines between the side support panels and the support panel. The method can include folding support flanges along respective fold lines between the support flanges and the side support panels.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
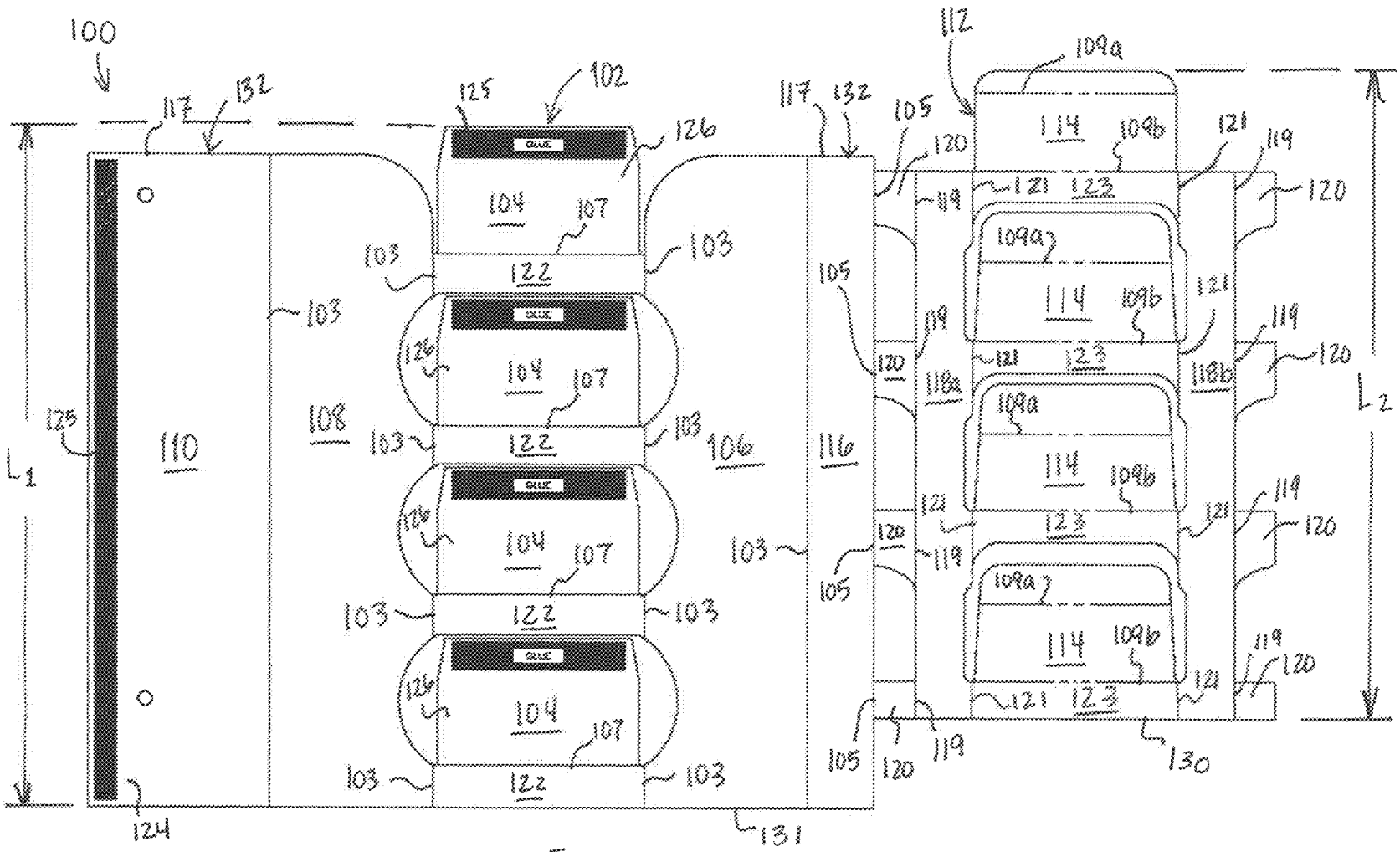
FIG. 1 is a plan view of an exemplary embodiment of a blank for a container constructed in accordance with the present disclosure, showing a shelf panel and a support panel.

Reference will now be made to the drawings wherein like reference numerals identify similar structural features or aspects of the subject disclosure. For purposes of explanation and illustration, and not limitation, a partial view of an exemplary embodiment of a blank constructed in accordance with the disclosure is shown in FIG. 1 and is designated generally by reference character 100. Other embodiments of containers in accordance with the disclosure, or aspects thereof, are provided in FIGS. 2-12, as will be described. The systems and methods described herein can be used to store product and can also be converted to display product such as in a retail setting. The embodiments of the present disclosure provide for a floor-stand style container with at least one supported shelf that is easy to make and use. Those skilled in the art will readily appreciate that embodiments of the present invention can also be used in a variety of other containers for shelf support.

As shown in FIG. 1, blank 100 forms a floor-stand style container 101 (shown in FIG. 5) that can be used for merchandising displays at a retail location. Embodiments of blank 100 and container 101 provide for a quick set-up and supported shelves, while not necessarily requiring hand finishing. Blank 100 for a container 101 includes a plurality of panels connected together at fold lines 103 configured to be folded at least partially around an interior space 111 (shown in FIG. 6), including a shelf panel 102 defining at least one shelf flap 104, a first side panel 108, a back panel 132 made up of a first back panel portion 110 and a second back panel portion 116, and a second side panel 106. It is contemplated that, in accordance with some embodiments, blank 100 can be a multi-piece blank formed in multiple pieces, or a single-piece blank, as shown.

Figure 2:
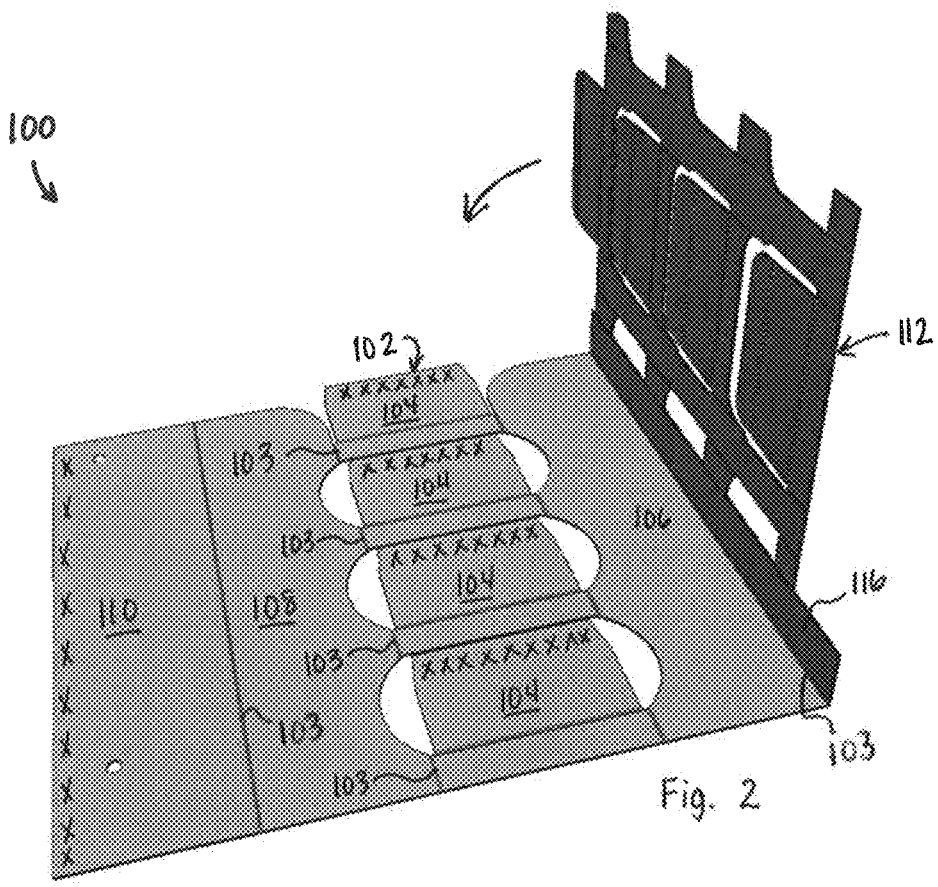
FIG. 2 is a perspective view the blank of FIG. 1, showing the support panel being folded onto the shelf panel.
Figure 3:
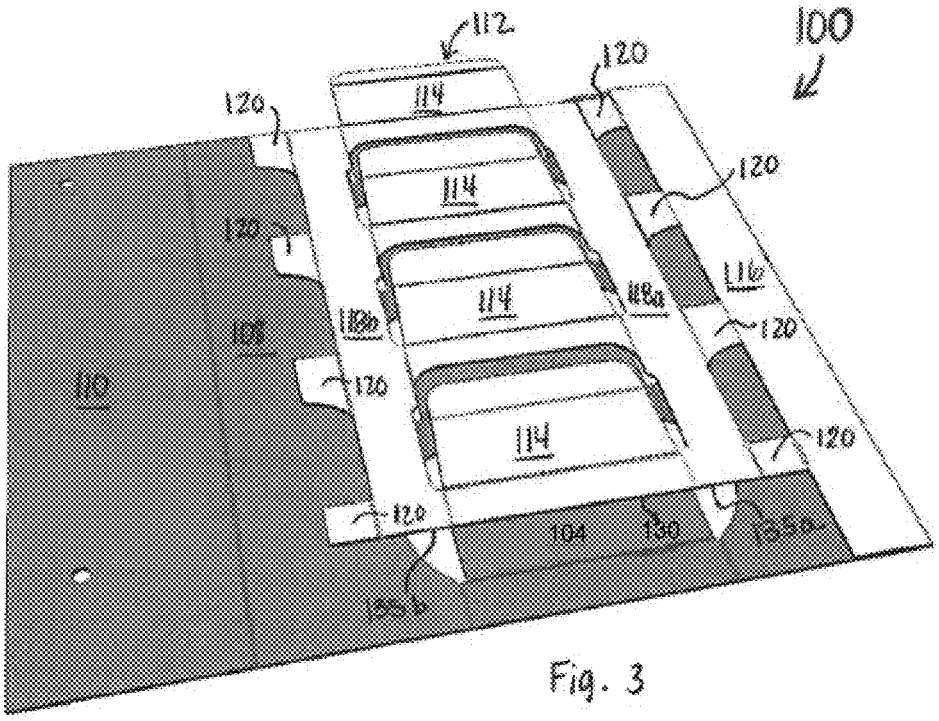
FIG. 3 is a perspective view of the blank of FIG. 1, showing the support panel folded onto the shelf panel.
Figure 4:
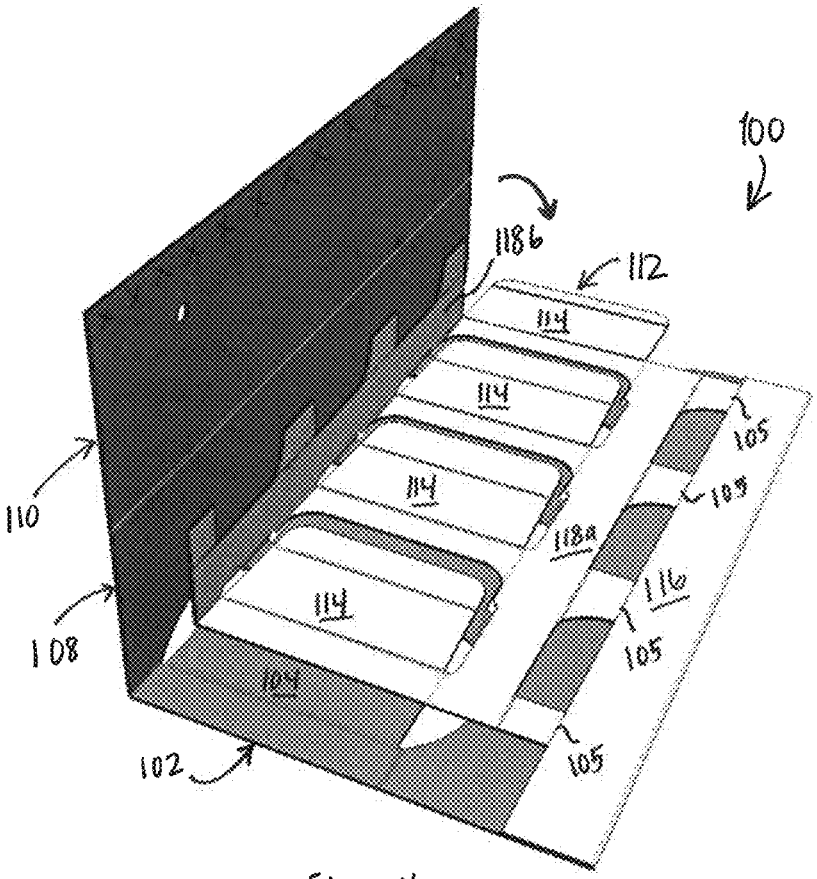
FIG. 4 is a perspective view of the blank of FIG. 1, showing the first back panel portion being folded onto the second back panel portion.

As shown in FIGS. 1 and 2, first side panel 108 is connected to shelf panel 102 along respective fold lines 103. Second side panel 106 is connected to shelf panel 102 along respective fold lines 103 opposite from first side panel 108. First back panel portion 110 is connected to first side panel 108 along one of fold lines 103. Second back panel portion 116 is connected to second side panel 106 along one of fold lines 103. Each shelf flap 104 is connected to a respective upright portion 122 of shelf panel 102 at a respective fold line 107. Blank 100 includes a support panel 112 defining shelf support flaps 114. Shelf panel 102 a length $L_1$ in the longitudinal direction of the container 101 (when folded) and support panel 112 has a length $L_2$ in the longitudinal direction. In the embodiment of FIG. 1, length $L_1$ of shelf panel 102 is greater than the length $L_2$ of support panel 112.

With continued reference to FIGS. 1 and 2, each shelf support flap 114 is connected to a respective upright portion 123 of support panel 112 at a respective fold line **109*b*. Fold lines described throughout the specification can be a variety of weakened lines and can include, among other things, scores, cuts, compressed areas, or the like. Blank 100 includes side support panels 118*a* and 118*b* connected to support panel 112 at respective fold lines 121. Blank 100 includes support flanges 120 connected to side support panels 118*a* and 118*b* at respective fold lines 119. There are a pair of support flanges 120 for each shelf support flap 114. Each pair of support flanges 120 extends from side support panels 118*a* and 118*b* at a vertical position aligned with a bottom edge of shelf support flap 114 (e.g. along fold line 109*b*). Support flanges 120 that extend from side support panel 118*a* are connected to back panel portion 116 along respective break lines 105. Break lines 105 are weakened to facilitate breaking second back panel portion 116 from support flanges 120 by at least one of a knife cut and/or perforations. As described in more detail below, support panel 112, support flanges 120 and side support panels 118*a* and 118*b* are configured to slide between a first position and a second position when shelf flaps 104 of shelf panel 102 are folded about their respective fold lines 107. Those skilled in the art will readily appreciate that any suitable number of perforation/break lines or arrangements thereof can be used. Break lines, e.g. perforation lines 105, are weakened to facilitate breaking support panel 112, side support panels 118*a* and 118*b*, and support flanges 120 from second back panel portion 116** by at least one of a knife cut and/or perforations.

With reference now to FIGS. 2-5, adhesion materials, such as glue, are applied to the interior surfaces 124 and 126 of first back panel portion 110 and shelf flaps 104. Glue can be applied in the form of glue dots shown schematically by "x" markings in FIG. 2 or glue can be applied in a solid strip as shown by the thick solid rectangles of FIG. 1. It is also contemplated that other suitable adhesion techniques and materials can be used. Glue 125 on first back panel portion 110 and shelf flaps 104 can be applied by way of a straight line gluing, as opposed to requiring special machine gluing.

Figure 5:
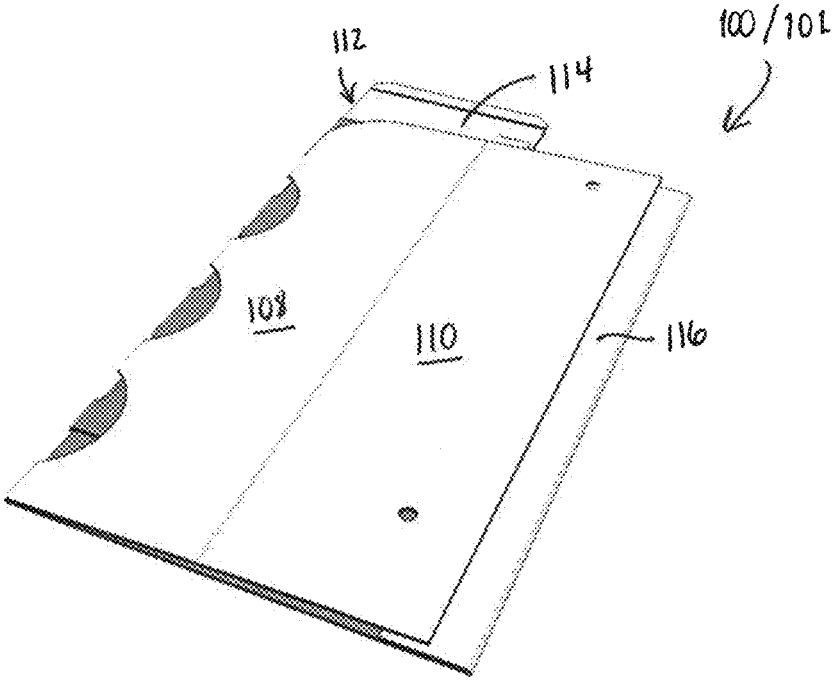
FIG. 5 is a perspective view of the blank of FIG. 1, showing the blank formed into a container from its back side in a flattened position.
Figure 6:
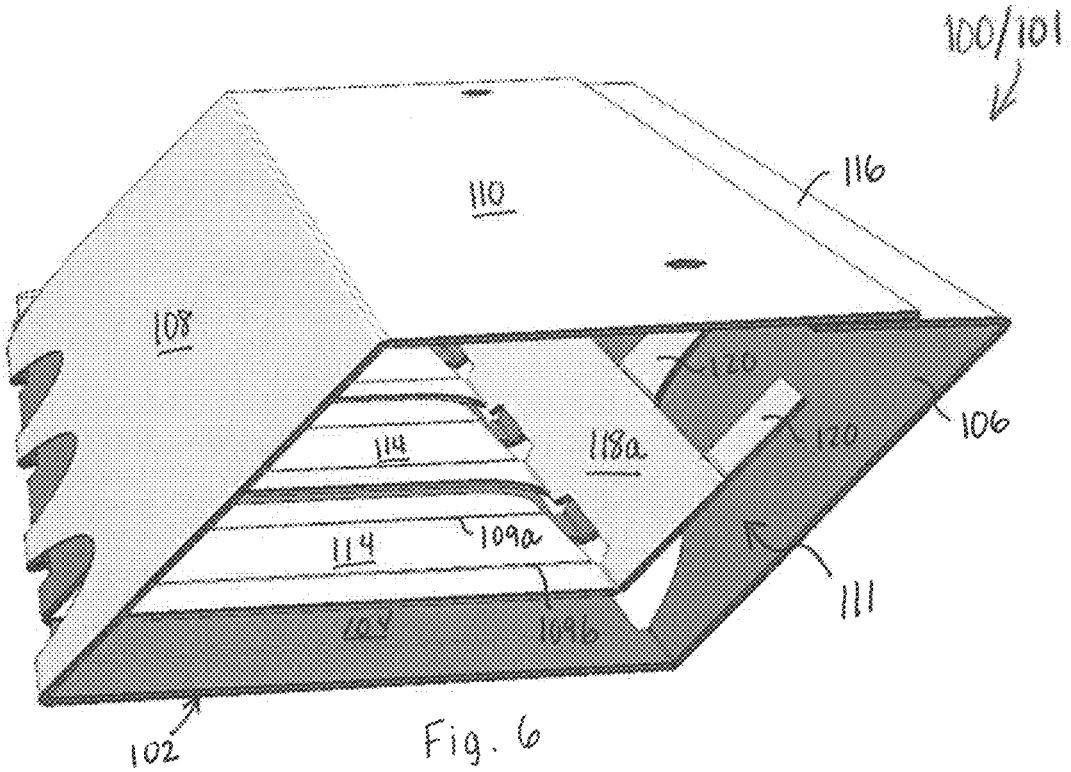
FIG. 6 is a bottom perspective view of the container of FIG. 5, showing the container being folded along respective fold lines to at least partially enclose an interior space and erect the container.

To form container 101 from blank 100, second back panel portion 116 is folded about fold line 103 toward second side panel 106, as shown in FIG. 2. Once folded, shelf support flaps 114 are operatively connected to respective shelf flaps 104 of shelf panel 102, e.g. by adhesion or the like. Break lines 105 are then severed to separate second back panel portion 116 from support flanges 120. First side panel 108 is folded about fold line 103 toward support panel 112 and shelf panel 102. Once folded, first back panel portion 110 and second back panel portion 116 are adhered together. After adhering first back panel portion 110 and second back panel portion 116, it is contemplated that container 101 can be shipped in its flattened state as shown in FIG. 5. Container 101 can then be erected at a retail location, or in another suitable location, as described in more detail below.

Figure 7:
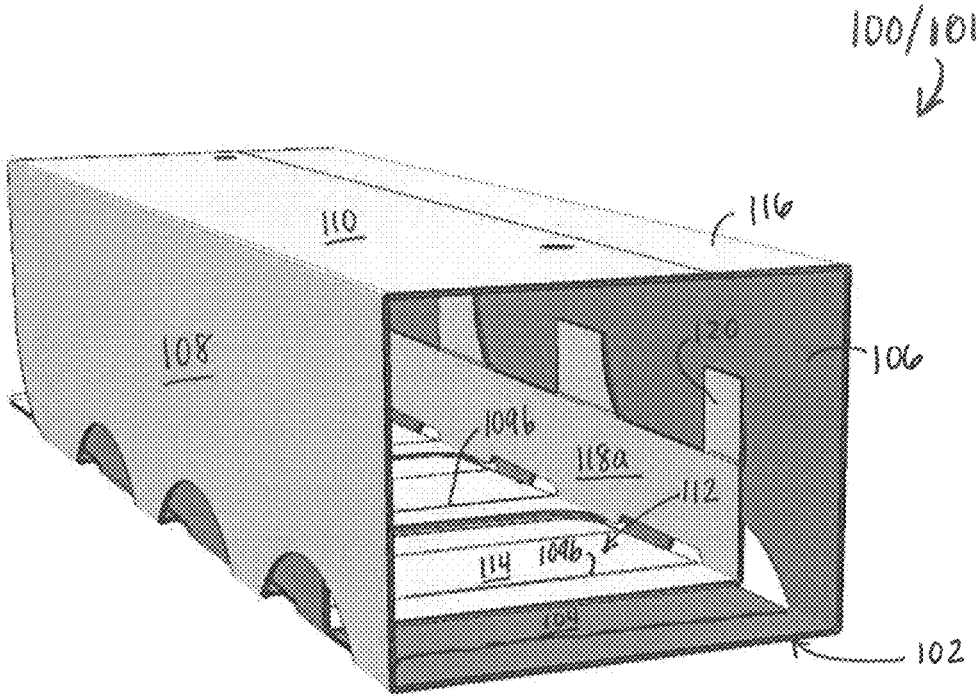
FIG. 7 is a bottom perspective view of the container of FIG. 5, showing the panels of the container folded along respective fold lines to at least partially enclose an interior space.
Figure 8:
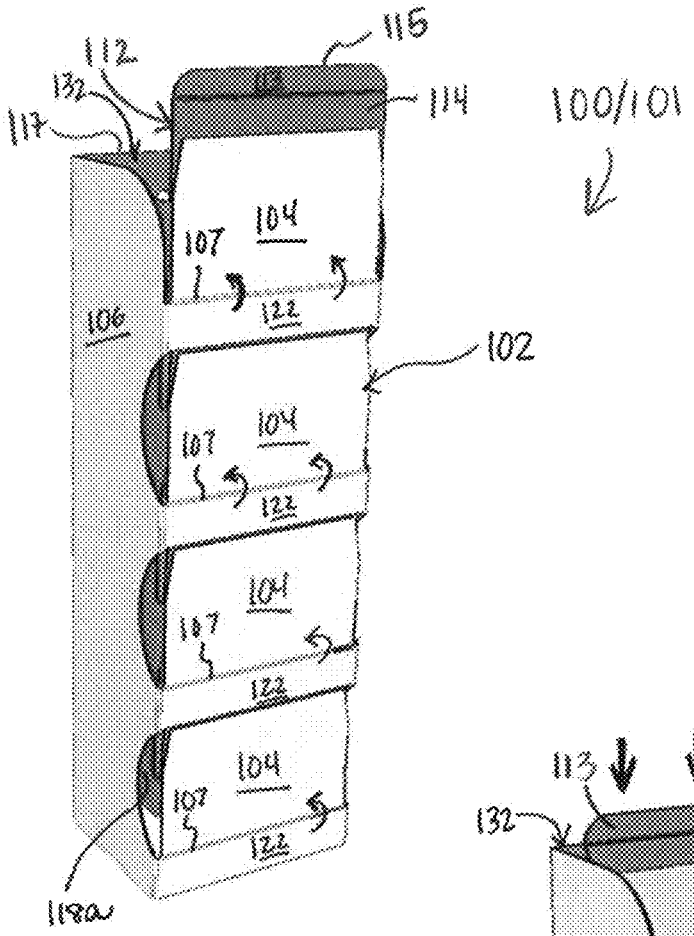
FIG. 8 is an upright front perspective view of the container of FIG. 5, showing the support panel and the shelf panel in unfolded positions.

With reference now to FIGS. 6-11, FIG. 6 shows a partially popped-up/erected container 101 from a bottom, back view. As the container is erected, because break lines 105 have been severed support panel 112 is free to move when shelf flaps 104 of shelf panel 102 are moved. FIGS. 7 and 8 show the container fully popped-up, but with support panel 112 and its shelf support flaps 114 still in their first position (e.g. not slid down yet). In FIG. 8, side support panels 118*a* and 118*b* have been folded about their respective fold lines 121 relative to support panel 112 such that side support panel 118*a* and its respective support flanges 120 abut second side panel 106 and side support panel 118*b* and its respective support flanges 120 abut first side panel 108. As shown in FIG. 8, shelf flaps 104 are folded about their respective fold lines 107 and, in turn, support panel 112 is slid down and pushed backward toward back panel 132 while each shelf support flap 114 is folded about its respective fold line 109*b*. The sliding is indicated schematically by the downward pointing arrows of FIG. 9 and the folding is indicated schematically by curved arrows about fold line 107 in FIGS. 8-9. Similarly, side support panels 118*a* and 118*b* and respective support flanges 120 also slide downward relative to their respective side panels 106 and 108 and move backward toward back panel 132. As side support panels 118*a* and 118*b* are slid downward and backward, support flanges 120 are folded about their respective fold lines 119 as they abut back panel 132. The sliding of support panel 112, side support panels 118*a* and 118*b* and support flanges 120 is achieved by folding the shelf flaps 104 along respective fold lines 107 toward back panel 132, by pushing support panel 112 downward, or both.

Figure 9:
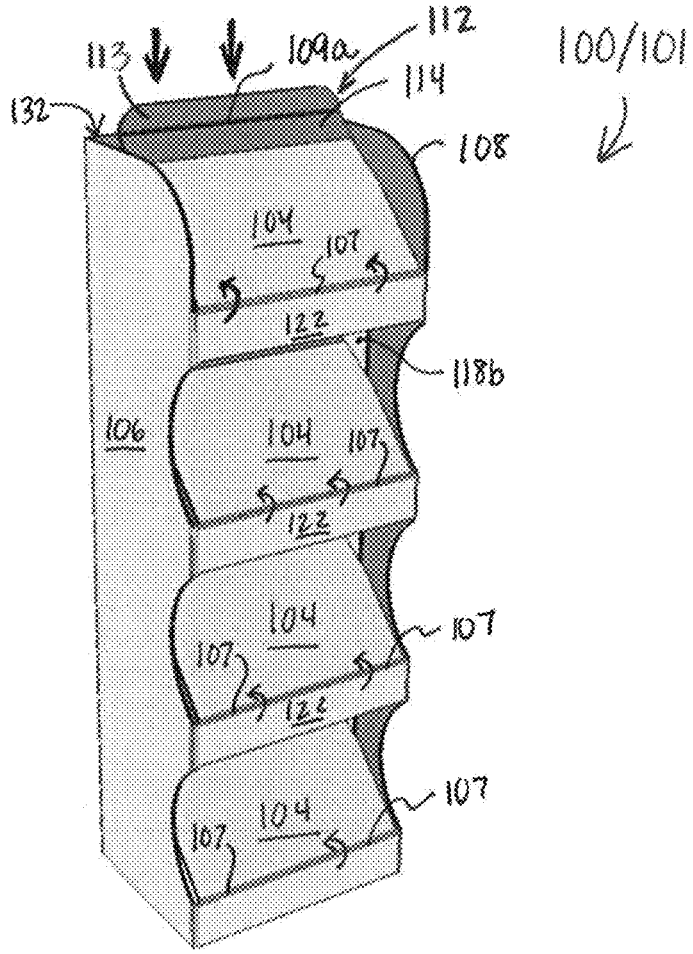
FIG. 9 is an upright front perspective view of the container of FIG. 5, showing the support panel and the shelf panel in partially folded positions.
Figure 10:
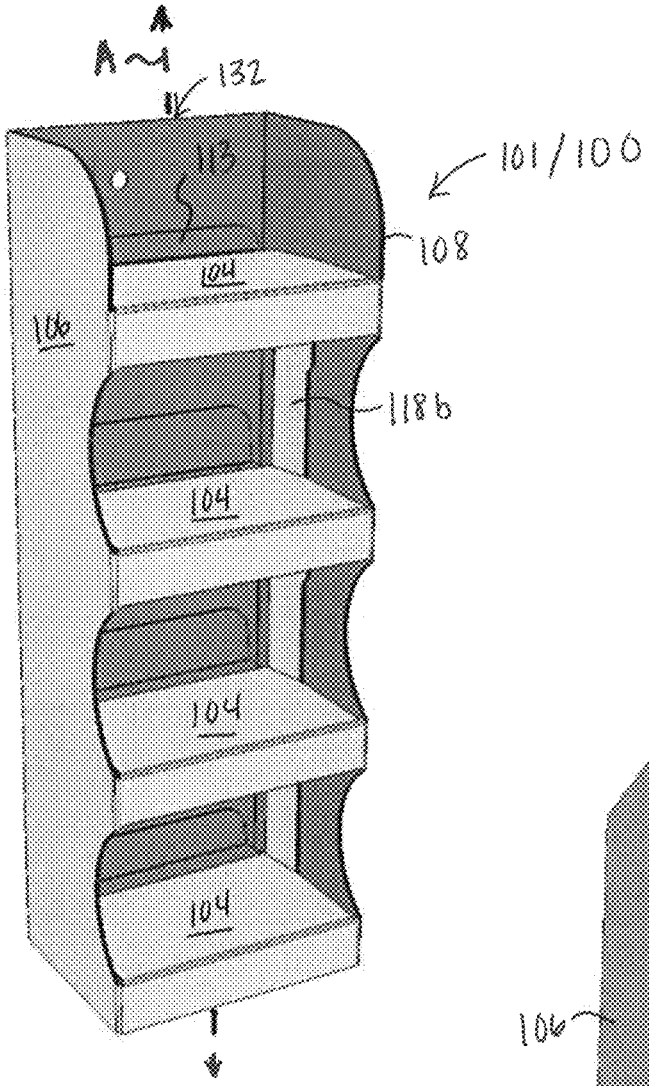
FIG. 10 is an upright front perspective view of the container of FIG. 5, showing the support panel and the shelf panel fully folded and/or slid down.
Figure 11:
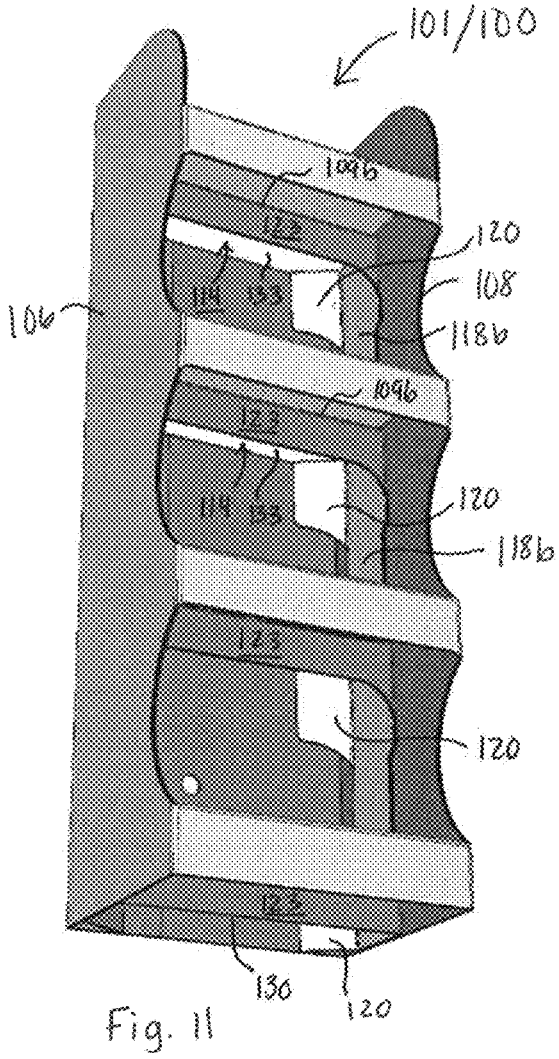
FIG. 11 is an upright front perspective view of the container of FIG. 5, showing the bottom of the container and the support flanges folded obliquely relative to their respective side support panels.
Figure 12:
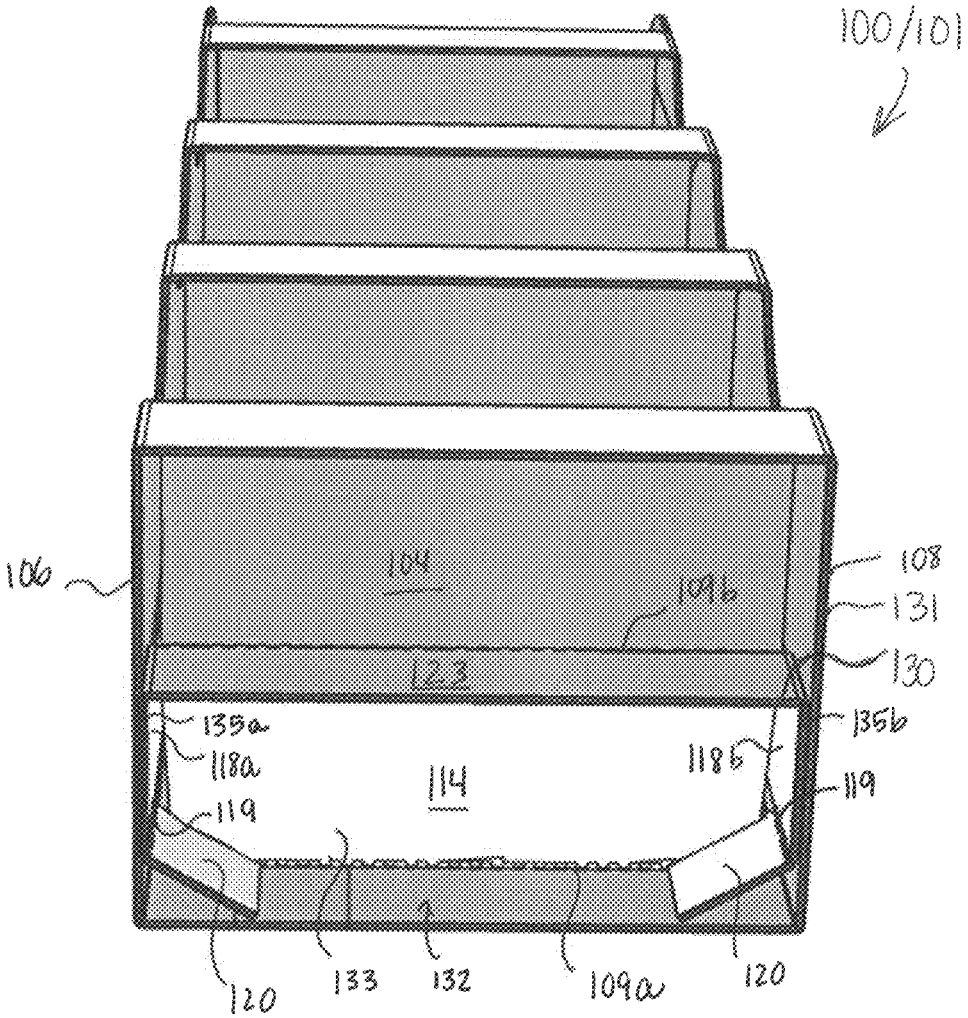
FIG. 12 is an bottom perspective view of the container of FIG. 5, showing the support flanges folded obliquely relative to their respective side support panels and supporting the shelf support flap and shelf flap.

As shown in FIGS. 8-10, support panel 112, support flanges 120 and side support panels 118*a* and 118*b* are slidable with respect to first and second back panel portions 110 and 116 between a first position shown in FIG. 8 and a second position shown in FIGS. 10-12. As support panel 112 moves, e.g. slides, downward, each end flap 113 of the shelf support flaps 114 is folded about a respective fold line 109*a* as it comes into contact with back panel 132. The first position is, for example, where a top edge 115 of support panel 112 is positioned above a top edge 117 of the back panel 132 (formed by first and second back panel portions 110 and 116) and where support panel 112 and shelf panel 101 are unfolded (shown in FIG. 8). The second position is, for example, where a bottom edge 130 of support panel 112 is approximately at the same position as a bottom edge 131 of first side panel 108 (shown in FIGS. 10-12).

With reference to FIGS. 11 and 12, when fully erected and with the support panel 112, side support panels 118*a* and 118*b* and support flanges 120 slid down and back into position, support flanges 120 are folded at an oblique angle, e.g. 45 degrees, relative to their respective side support panels 118*a* and 118*b* and abut respective underside surfaces 133 of each shelf support flap 114. In this way, each pair of support flanges 120 act as support beams when folded underneath their respective shelf support flaps 114 to provide support for the shelf support flaps 114 and, in turn, the shelf flaps 104. When container 101 is erected, each shelf flap 104 overlaps at least a portion of its respective shelf support flap 114 such that each shelf support flap 104 is positioned above its respective shelf support flap 114 along a longitudinal axis A of the erected container 101 (shown in FIG. 10). Loads from each shelf flap 104 are transmitted through its respective shelf support flap 114, through support flanges 120 and into side support panels 118*a* and/or 118*b*. Loads can also be transferred through shelf support flaps 114 and upright portion 123 of support panel 112 to side support panels 118*a* and 118*b*. Bottom most edges 135*a* and 135*b* of support panels 118*a* and 118*b* are configured to abut a floor when assembled, so the loads are, in turn, transferred to the floor. Edges of the bottom most support flanges 120 (e.g. those shown in FIG. 12) opposite from the underside surface 133 abut a floor, for example, such that forces transferred to support flanges 120 may be directly transferred to the floor. The same goes for a bottom most edge 130, of support panel 112.

A method of forming a container, e.g. container 101, includes folding a plurality of panels, e.g. panels/portions 102, 106, 108, 132, 110, 112, 116, 118*a*, 118*b*, 120 of a blank, e.g. blank 100, connected together at fold lines, e.g. fold lines 103, at least partially around an interior space, e.g. interior space 111. Folding the plurality of panels includes folding a support panel, e.g. support panel 112, about a fold line, e.g. fold line 105, between the back panel, e.g. back panel 132, formed in part by first and second back panel portions, e.g. first and second back panel portions 110 and 116, and the support panel. The method includes adhering shelf support flaps, e.g. shelf support flaps 114, to shelf flaps, e.g. shelf flap 104. The method includes separating the support panel from the back panel along a break line, e.g. break line 105. Folding the plurality of panels includes folding the first side panel along fold lines, e.g. fold lines 103, between the first side panel, e.g. first side panel 108, and the shelf panel, e.g. shelf panel 102. The method includes adhering first and second back panel portions. The method includes folding side support panels, e.g. side support panels 118*a* and 118*b*, along respective fold lines, e.g. fold lines 121, between the side support panels and the support panel and folding the back panel along respective fold lines, e.g. fold lines 103, between the back panel and first and second side panels, e.g. first and second side panels 108 and 106, to erect the container.

Once erected (or concurrently therewith) the method includes folding each shelf flap along a respective fold line, e.g. fold line 107, between the shelf flaps and respective upright portions, e.g. upright portions 122, of the shelf panel and sliding the support panel, side support panels and support flanges, e.g. support flanges 120, downward relative to the back panel from a first position to a second position. The sliding is indicated schematically by the downward pointing arrows of FIG. 9 and the folding is indicated schematically by curved arrows about fold line 107 in FIGS. 8-9. The method includes folding support flanges along respective fold lines, e.g. fold lines 119, between the support flanges and side support panels. When fully erected, with the support panel, side support panels and support flanges slid down and back into position, support flanges are folded at an oblique angle, e.g. 45 degrees, relative to their respective side support panels and abut an underside surface, e.g.

underside surface 133, of the shelf support flap. In this way, support flanges provide support for the shelf support flaps and, in turn, the shelf flaps. Edges of the bottom most support flanges (e.g. those shown in FIG. 12) opposite from the underside surface abut a floor, for example, such that forces transferred to support flanges are transferred thereto. The same goes for the bottom most edges, e.g. edges 135*a* and 135*b*, of the side support panels and a bottom most edge, e.g. edge 130, of support panel.

While shown and described in the exemplary context of a floor-stand style display container, those skilled in the art will readily appreciation that any other suitable container style can be formed without departing from the scope of this disclosure. Blanks and containers as disclosed herein can be constructed of any suitable material such as corrugated paper board. The methods and systems of the present disclosure, as described above and shown in the drawings, provide for containers with superior properties including increased shelf support, ease of manufacturing due to the capability for straight line gluing, and quick pop-up at a retail location. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A container comprising:

a plurality of panels connected together at fold lines configured for extending at least partially around an interior space, where the plurality of panels includes, a first side panel, a back panel, a second side panel, and a shelf panel defining at least one shelf flap;

a support panel defining at least one shelf support flap, wherein the at least one shelf support flap is operatively connected to the at least one shelf flap of the shelf panel, and wherein the support panel is configured to move between a first position and a second position when the at least one shelf flap of the shelf panel is folded;

side support panels connected to the support panel at respective fold lines; and support flanges connected to the side support panels at respective fold lines, wherein the support flanges are configured to be folded at an oblique angle relative to their respective side support panels and abut an underside surface of the at least one shelf support flap, wherein the support flanges defines a first plane, the side support panel defines a second plane, and the back panel defines a third plane, wherein the first plane is oblique to both the second and third planes.

2. The container as recited in claim 1, wherein the first side panel is connected to the shelf panel along a respective one of the fold lines, and wherein the second side panel is connected to the shelf panel along a respective one of the fold lines opposite from the first side panel.

3. The container as recited in claim 1, wherein the support panel is configured to move between the first position and the second position when the at least one shelf flap of the shelf panel is folded about a respective fold line between the at least one shelf flap and an upright portion of the shelf panel.

4. The container as recited in claim 1, wherein the support flanges and the side support panels are configured to slide between a first position and a second position when the at least one shelf flap of the shelf panel is folded about a respective fold line between the at least one shelf flap and an upright portion of the shelf panel.

* * * * *